United States Patent [19]

Sterner

[11] Patent Number: 4,511,284

[45] Date of Patent: Apr. 16, 1985

[54] POTHOLE PATCHER

[76] Inventor: Carl L. Sterner, Rte. 4, Box 372, Bakersfield, Calif. 93309

[21] Appl. No.: 521,945

[22] Filed: Aug. 10, 1983

[51] Int. Cl.[3] ..... E01C 19/10; E01C 19/18

[52] U.S. Cl. ..... 404/111; 404/108; 239/654; 239/663

[58] Field of Search ..... 404/111, 104, 107–110; 239/663, 654, 289; 406/56, 61, 47; 222/132, 136

[56] References Cited

U.S. PATENT DOCUMENTS

| | | | |
|---|---|---|---|
| 1,165,331 | 12/1915 | Gray | 404/111 X |
| 1,487,454 | 3/1924 | Gardiner | 404/110 X |
| 1,546,185 | 7/1925 | Andresen | 404/111 X |
| 1,750,104 | 3/1930 | Heltzel | 404/107 |
| 1,785,932 | 12/1930 | Brown et al. | 239/654 X |
| 2,420,410 | 5/1947 | Blankner | 404/107 X |
| 2,578,080 | 12/1951 | Middlestadt | 404/107 |
| 2,830,510 | 4/1958 | Mariani et al. | 239/654 X |
| 3,217,620 | 11/1965 | Mindrum et al. | 404/103 |
| 3,260,176 | 7/1966 | Bowers | 404/111 |
| 3,625,120 | 12/1971 | Nagy | 404/107 |
| 3,712,681 | 1/1973 | Marino et al. | 406/61 X |

FOREIGN PATENT DOCUMENTS

| | | | |
|---|---|---|---|
| 841060 | 5/1939 | France | 406/47 |
| 2094886 | 2/1972 | France | 406/47 |

*Primary Examiner*—James A. Leppink
*Assistant Examiner*—Beverly E. Hjorth
*Attorney, Agent, or Firm*—Robert R. Thornton

[57] ABSTRACT

A truck frame for road repair work includes a tank containing heated asphalt, a repair materials hopper, a front discharge chute and a drive worm conveyor within the hopper for moving repair aggregate from the hopper to the chute for deposit in a pavement pothole or the like. The discharge end of the chute is manually moveable from side to side and front to back and carries an outlet for the heated asphalt to coat the aggregate emerging from the chute with the asphalt, for spreading the asphalt coated aggregate into the pavement defect being repaired. The chute has a first air inlet attached thereto remote from the discharge in and through which air under pressure is applied to the chute to cause a swirling motion of the aggregate as it descends through the chute toward the pavement, and a second air inlet at the opposite end from the outlet for receiving air under pressure to clean a pothole before the repair material is applied thereto.

7 Claims, 6 Drawing Figures

POTHOLE PATCHER

FIELD OF THE INVENTION

This invention relates to roadway maintenance apparatus of the type embodying a four-wheeled frame which transports road repair material to the site to be repaired and applies the material to effect the repair.

SUMMARY OF THE PRIOR ART

Devices are known for repairing holes in streets and highways, commonly known as "potholes". Absent a complete repaving of the street or highway, these potholes are "patched" by filling the pothole with a combination of aggregate material such as gravel and a heated bitumen, such as asphalt or an asphalt emulsion. Devices for making such repairs are known, and for example, are shown in U.S. Pat. No. 3,217,620, issued Nov. 16, 1965, to K. H. Mindrum, et al., and U.S. Pat. No. 3,625,120, issued Dec. 7, 1971, to Joseph Nagy. In each of these patents, a self-propelled four-wheel frame carries a hopper containing aggregate material which has been pre-mixed with a bitumen binder, such as asphalt or an emulsified asphalt binder. The pre-mixed material is conveyed from the hopper by a screw conveyor to the location for application to the pothole. In such devices, the pre-mixing of the aggregate and binder material requires that the combined material be heated in order to maintain a sufficient state of fluidity for application to the pothole. However, such heating is not readily accomplished and requires an excessive application of heat to maintain a sufficient fluidity of the material during transport from the hopper to the situs of its application. Additionally, the application of the pre-mixed material is difficult due to its tendency to lump together before application to the pothole.

Also known are devices for applying heated liquid asphalt to pavement. Such devices are shown in U.S. Pat. No. 1,750,104, issued Mar. 11, 1930 to J. N. Hetzel; U.S. Pat. No. 2,420,410, issued May 13, 1947 to W. Blanker, and U.S. Pat. No. 2,578,080, issued Dec. 11, 1951 to W. F. Middlestadt. Such devices are not, however, satisfactory for patching potholes, being directed toward filling seams or cracks in the pavement.

BRIEF SUMMARY OF THE INVENTION

According to the present invention, a pothole patcher has a vehicle frame, a pair of front wheels and a pair of rear wheels, an aggregate material hopper with an upwardly inclined bottom mounted on said vehicle frame, an inclined conveyor screw in the hopper bottom, means for driving said screw, conveyor tube means communicating with the bottom of said hopper and extending upwardly to the forward end of said hopper, a discharge chute connected to the forward end of said conveyor tube means and having a discharge outlet extending downwardly beyond the front end of said vehicle frame for dispensing aggregate material therefrom, said conveyor screw conveying aggregate material from said hopper to said discharge chute for deposit in a pothole to be repaired, an asphalt-containing tank mounted on the frame within which heated asphalt is contained, means for delivering said heated asphalt to the outlet of the discharge chute so as to coat aggregate material as it is dispensed from the discharge chute, an air inlet tangentially mounted on said discharge chute between the conveyor screw and the asphalt outlet and means operable, when actuated, to force air through the air inlet to create a helical downward movement of aggregate material as it passes through the discharge chute. A second air supply means applies air under pressure to the top of the chute to clean the pothole before patching and, if desired, to blow the aggregate through the chute to increase its velocity upon striking the pothole over that provided by gravity alone.

BRIEF DESCRIPTION OF THE DRAWING

The invention may be more readily understood by referring to the accompanying drawing in which.

DETAILED DESCRIPTION OF THE INVENTION

Figure 1:
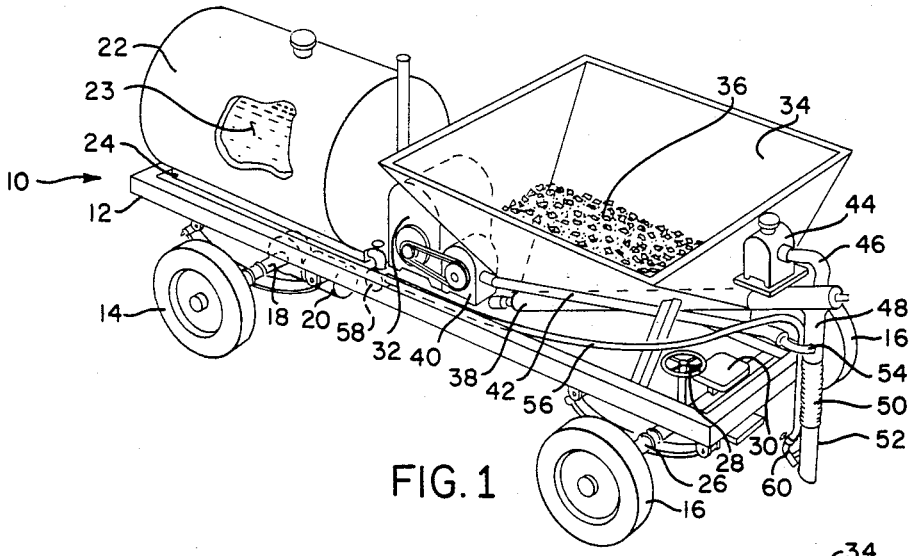
FIG. 1 is an isometric view of a pothole patcher, according to the present invention.

Referring now to FIG. 1, there is shown a pothole patcher 10 which includes a generally rectangular vehicle frame 12, a pair of rear wheels 14 (only one of which is shown in FIG. 1) and a pair of front wheels 16. The wheels 14, if desired, are connected together by rear axle 18, which may include a drive source 20 of any conventional type. The details of the drive source, if desired, do not constitute a material part of the present invention and any conventional drive mechanism may be utilized with its accompanying controls. Mounted over the rear axle 18 is a tank 22, shown partially broken away in FIG. 1, which contains road patching material 23, such as asphalt. At the base of tank 22 is a fire box assembly 24 of conventional form utilized to maintain the asphalt in a fluid state. The front wheels 16 may be connected together by a front axle 26 which may be of any conventional structure and which may be steerable by means of a steering wheel 28, if desired. An operator's seat 30 is provided on the frame 12 over the front axle 26 and generally centered between the front wheels 16, while the steering wheel 28 is offset toward the right front wheel 16.

Immediately forward of the asphalt tank 22 there is located a diesel engine 32. A hopper 34, located forward of the diesel engine 32, contains aggregate material 36 of the type desired to be utilized to patch the pothole to be repaired. At the base of the hopper 36 is a cylindrical feed tube 38 which closes the bottom of the hopper and is inclined upwardly away from the diesel engine 32. Located between the diesel engine 32 and the hopper 34 is a first air blower 40 selectively actuated by the diesel engine 32, and to which is connected a first air hose 42. Immediately forward of the hopper 34 is a self-powered second air blower 44, to which is connected a second air hose 46. The pothole patcher 10 has a material chute 48 which is closed at one end by being connected to the second air hose 46. The material chute 48 is generally vertically disposed forward of the rectangular frame 12 and includes a flexible portion 50 and an outlet portion 52. As will be seen in FIG. 1, the cylindrical feed tube 38 passes through the material chute 48 between the connection of the second air hose 46 to the material chute 48 and the flexible portion 50. The material chute 48 also has a first blower air inlet 54 connected thereto so as to be disposed between the cylindrical tube 38 and the flexible portion 50. The first blower air inlet 54 is preferably tangentially attached to the chute 48. The first blower air inlet 54 is connected to the first air hose 42. An asphalt feed hose 56 is connected between an asphalt pump 58 and an asphalt outlet nozzle 60 attached to the outlet portion 52 of the material chute 48. A valve 60A controls the flow of asphalt to the asphalt outlet nozzle 60.

Figure 2:
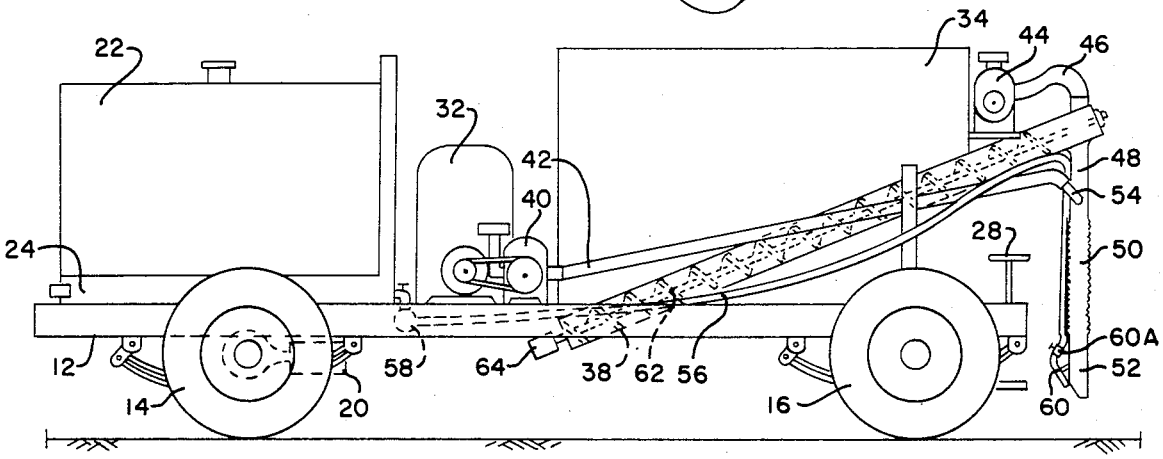
FIG. 2 is a right-side elevational view of the pothole patcher of FIG. 1, illustrating its material chute and worm conveyor.

Referring now to FIG. 2, the pothole patcher 10 is shown in a right side elevational view. The cylindrical feed tube 38 is shown in FIG. 2, in dotted lines, to contain a worm screw conveyor 62, which is driven by a conveyor drive means 64, of any conventional type. The first blower air inlet tube 54 is seen in FIG. 2 to be inclined at an acute angle with respect to the vertically disposed material chute 48. In the preferred embodiment this angle is approximately forty-four degrees. Also shown in FIG. 2 is the inclination with respect to the vertically disposed chute outlet portion 52 of the asphalt outlet nozzle 60. In the preferred embodiment, this angle is twenty-one degrees.

The operation of the pothole patcher 10 will now be described. The pothole patcher 10 is driven or towed into position so that the material chute outlet 52 is disposed over a pothole 66 to be patched. The second air blower 44 is activated, blowing air at a high velocity down the material chute 48 and out the material chute outlet 52 so as to be directed into the pothole 66, thereby cleaning the pothole 66 of debris. The flexible portion 50 of the material chute 48 permits the operator to direct the air about the pothole as desired to ensure complete debris removal for a large pothole 66A (see FIG. 4). When the pothole has been cleaned, the second air blower is deactuated, terminating the flow of air through the material chute 58.

Next, rotation of the screw conveyor 62 feeds uncoated aggregate material 36 from the hopper 34 upwardly through the cylindrical feed tube 38 until the aggregate material reaches the material chute 48. Upon reaching the material chute 48 the aggregate material 36 drops downwardly through the chute 48 under the influence of gravity. If desired, the second air blower 44 may be actuated to increase the downward velocity of the aggregate in the material chute 48.

Figure 3:
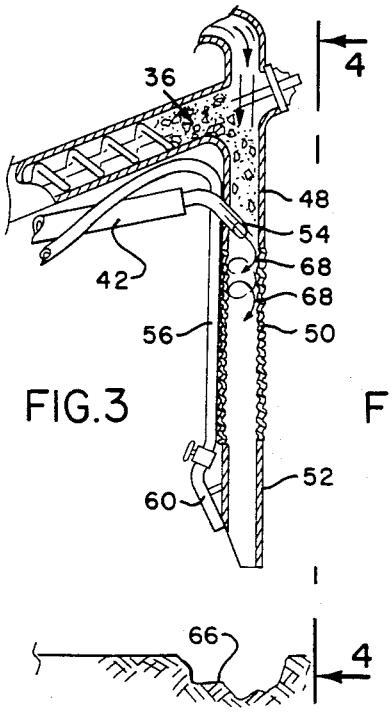
FIG. 3 is a partial sectional view of the material chute and worm conveyor shown in FIG. 2.
Figure 5:
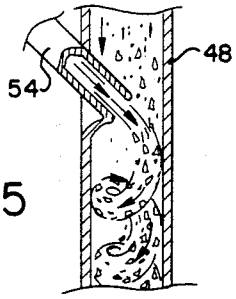
FIG. 5 is a partial sectional view of the material chute illustrating the air inlet and the swirling motion of the aggregate therewithin.

In FIG. 3, which is a partial sectional view of the material chute and worm conveyor shown in FIG. 2, the aggregate material 36 is shown as falling downwardly in the chute 48 toward the first blower air inlet tube 54. As has been previously stated, the first blower air inlet tube 54 is preferably tangentially disposed on the material chute 48 so that, when the first air blower 40 is energized, air is forced through the first air hose 42 and the first blower air inlet tube 54 into the material chute 48 in a helical or "swirling" motion, so as to impart a similar motion to the falling aggregate material 36. This aggregate helical flow, indicated by the arrows 68, is shown in idealized fashion in greater detail in FIG. 5.

Figure 4:
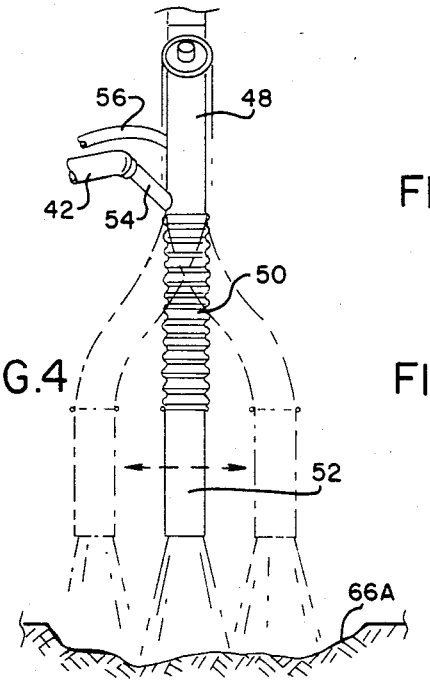
FIG. 4 is a view taken along lines 4—4 of FIG. 3 illustrating side-to-side movement capability of the material chute outlet.
Figure 6:
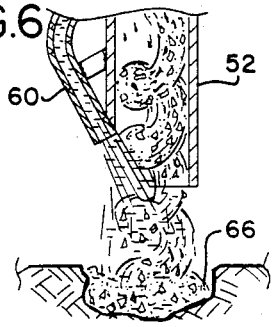
FIG. 6 is a partial sectional view of the material chute outlet illustrating the mixing of the heated asphalt and aggregate.

As has been previously stated, the asphalt outlet nozzle 60 is disposed at the lower open end of the discharge chute outlet portion 52. Asphalt, heated in the tank 22 by the fire box assembly 24, is forced through the asphalt feed hose 56 by the asphalt pump 58 and, when the valve 60A is opened, passes through the asphalt nozzle 60 into intimate contact with the swirling aggregate material, thereby coating the individual aggregate pieces with asphalt. The asphalt coated aggregate pieces are then applied to the pothole to be patched in order to fill the pothole, as is shown in FIG. 6. Because the pothole may be larger than the diameter portion 52, the material chute has a flexible portion 50 which permits transverse movement of the outlet portion 52, as is shown in FIG. 4, to apply the asphalt coated aggregate material over a wide surface area to adequately fill the pothole without the necessity of moving the frame 12.

It has been found that the asphalt coated aggregate material, according to the practice of the invention, is applied to the pothole with sufficient force to sufficiently compact the patch such that a separate rolling step is not required. The patch is made so as to rise slightly above the surrounding roadway, and the passage of vehicles over the patch in normal usage provides sufficient additional compaction to level the patch. It has been found that the helical flow of the aggregate as it is dispensed from the outlet 52 provides the necessary turbulence to permit coating of the material with asphalt while using only a simple asphalt outlet nozzle. The inclination of the first air outlet 54 normally provides sufficient downward velocity to the aggregate material that the second air blower is not required to achieve the necessary compaction of the patch. However, it is, of course, within the scope of the invention to utilize the second air blower to provide the downward thrust for the aggregate material and thereby eliminate the angular offset of the first air inlet 54 from the horizontal. Obviously, also, differing degrees of offset may be utilized with differing quantities of air delivered through the first air inlet 54. In the preferred embodiment, an air inlet tube of $1\frac{1}{4}$ inch diameter is used together with a first air blower of 140 c.f.m. capacity to provide the requisite swirling or helical motion to the aggregate material prior to coating, for a chute of 4 inches diameter and an aggregate feed rate of 100 pounds per minute.

I claim:

1. In a road repair truck of the type having a vehicle frame amounted on a pair of front wheels and a pair of rear wheels, an aggregate material hopper on said vehicle frame, a conveyor screw in the hopper bottom, means for driving said screw, a conveyor tube forming the bottom of said hopper and extending from the forward end of said hopper and within which said conveyor screw is disposed, and a vertically disposed discharge chute connected to the forward end of said conveyor tube and having a discharge outlet extending downwardly below the conveyor tube beyond the front end of said vehicle frame for dispensing aggregate material therefrom, said conveyor screw conveying aggregate material from said hopper to said discharge chute for deposit in a pothole to be repaired, means for applying asphalt coated aggregate to the road to be repaired comprising a first air inlet formed on the discharge chute between the conveyor screw and the discharge outlet, means for applying a flow of air to the air inlet so as to create a helical downward flow of aggregate material in the chute, an asphalt outlet disposed at the discharge outlet, and means for applying heated asphalt under pressure to the asphalt outlet, said asphalt outlet being disposed with respect to the discharge chute outlet so that, upon the aggregate material passing through the discharge outlet, asphalt from the asphalt outlet is sprayed thereon.

2. A road repair truck according to claim 1, and in which the first air inlet tangentially intersects the discharge chute.

3. A road repair truck according to claim 2, and in which the first air inlet intersects the chute at an angle of about forty-four degrees.

4. A road repair truck according to claim 1, and including a second air inlet formed on the discharge chute above the conveyor tube, and means for selectively applying a flow of air under pressure to said second air inlet.

5. A road repair truck according to claim 4, and in which the first air inlet tangentially intersects the discharge chute.

6. A road repair truck according to claim 5, and in which the asphalt outlet intersects the discharge outlet at an angle of about twenty-one degrees and the first air inlet intersects the chute at an angle of about forty-four degrees.

7. A road repair truck according to claim 1, and in which the asphalt outlet intersects the discharge outlet at an angle of about twenty-one degrees.

* * * * *